United States Patent [19]

Jorgensen

[11] Patent Number: 4,626,261

[45] Date of Patent: Dec. 2, 1986

[54] METHOD OF CONTROLLING INTERMITTENT VOLTAGE SUPPLY TO AN ELECTROSTATIC PRECIPITATOR

[75] Inventor: Hans J. Jorgensen, Lyngby, Denmark

[73] Assignee: F. L. Smidth & Co. A/S, Copenhagen, Denmark

[21] Appl. No.: 808,045

[22] Filed: Dec. 12, 1985

[30] Foreign Application Priority Data

Dec. 12, 1984 [GB] United Kingdom ..... 8431294

[51] Int. Cl.[4] ..... B03C 3/68

[52] U.S. Cl. ..... 55/2; 55/105; 323/903

[58] Field of Search ..... 55/2, 105, 4, 139; 323/903

[56] References Cited

U.S. PATENT DOCUMENTS

| | | | |
|---|---|---|---|
| 3,984,215 | 10/1976 | Zucker | 55/105 X |
| 4,138,233 | 2/1979 | Masuda | 55/139 |
| 4,410,849 | 10/1983 | Ando | 55/105 X |
| 4,486,704 | 12/1984 | Gustafsson et al. | 55/105 X |
| 4,502,002 | 2/1985 | Ando | 55/105 X |

*Primary Examiner*—Kathleen J. Prunner

*Attorney, Agent, or Firm*—Brumbaugh, Graves, Donohue & Raymond

[57] ABSTRACT

In the method of controlling the period length of an intermittent voltage supply to an electrostatic precipitator, a search procedure is carried out at predetermined time intervals or at time intervals determined by one or more continuously monitored/measured precipitator or operational parameters. During the search procedure either the number of system voltage half-periods during which the power supply to the precipitator is cut off (the length of the non-conduction ($n_p$) period), or the number of system voltage half-periods during which the power supply supplies current to the precipitator (the length of the conduction period), are changed according to a predetermined scale or to a scale determined by one or more precipitator or operational parameters. The charge transmitted per system half-period is current in the precipitator divided by the total number of half-periods of conduction per second. The search is stopped when the relation between the charge transmitted per system half-period and the maximum voltage at transition from one search stage to the succeeding one remains constant or increases and the number of system half-periods, of conduction or non-conduction ($n_p$) respectively, existing when the search is stopped is maintained until the next search procedure.

17 Claims, 4 Drawing Figures

METHOD OF CONTROLLING INTERMITTENT VOLTAGE SUPPLY TO AN ELECTROSTATIC PRECIPITATOR

The invention relates to a method of controlling the period length of an intermittent voltage supply to an electrostatic precipitator to obtain maximum cleaning of the gas passed through the electrostatic precipitator.

From U.S. Pat. No. 4,410,849 it is known to supply an electrostatic precipitator with an intermittent direct voltage, i.e. so that the voltage difference between the precipitator electrodes is periodically high and then low. By changing the length of the periods of high and low voltage it is possible to control the precipitator current and reduce the energy consumption in the precipitator as compared with conventional direct current operated precipitators.

The advantage of an intermittent voltage is that the periods of high voltage can be made so short that no back-corona occurs. On the other hand it is desirable to operate the precipitator as closely as possible to the limit of back-corona.

Consequently, it is the object of the invention to provide a method by which the periods of high and low voltage are controlled in such a way that the precipitator is operated to the limit of an operational condition with back-corona.

Direct current to the precipitator is provided by a rectified alternating current, the current supplied during individual half periods of direct current from the supply being controlled to conduct to the precipitator or not conduct by suitable switching. Thus during any system half period of rectified current the system may actually conduct for a period of time different from the system half period itself, or may even not conduct at all.

The object is achieved by a method according to the invention, characterized in that a search procedure is carried out at predetermined time intervals during which:

- a series of increasing values is given to the ratio $n_c/n_p$ between the number of conduction half periods $n_c$ during which the power supply supplies current to the precipitator and the number of non-conduction half periods $n_p$ during which the power supply to the precipitator is cut off, the increasing values being obtained through stepwise altering of one or both of the numbers $n_c$ or $n_p$ according to a selected scale;
- the charge transmitted per system half-period is calculated at each scale state, this charge being defined as the average current of the precipitator divided by the total number $n_c$ of conduction system half-periods per second;
- the search procedure is stopped when the ratio between the maximum voltage and the charge transmitted per system half-period remains constant or decreases at transition from one scale stage to the succeeding one; and,
- the number of conduction system half-periods $n_c$ and of non-conduction system half-periods $n_p$ so obtained determining the numbers of conduction system half-periods and non-conduction system half-periods to be maintained until the next search procedure.

Preferably, the predetermination of the time intervals between the search procedures is automatically performed on the basis of one or more continuously monitored/measured precipitator or operation parameters, for example the temperature within the precipitator.

Preferably, the predetermination of the scale for changing the number of non-conduction or conduction half-periods is automatically performed in advance of each search procedure on the basis of one or more continuously monitored/measured precipitator or operational parameters in the same way.

The method may be carried out by keeping the maximum voltages and the length of non-conduction constant during the search procedure, during which the length of conduction (number of system half-periods of conduction) is first, if possible, reduced and then increased stepwise until the charge per conduction system half-period has assumed a minimum or has become constant, whereafter the number of conduction system half-periods by which the charge per conduction system half-period was minimal or became constant is maintained in the time until the next search procedure.

If, on the other hand, it is desired to vary the length of non-conduction then the maximum voltage and the length of conduction may be kept constant during the search procedure, during which the length of non-conduction (number of system half-periods of non-conduction), if possible, is first increased and then reduced stepwise until the charge per conduction system half-period has assumed a minimum or has become constant, whereafter the number of non-conduction system half-periods by which the charge per conduction system half-period was minimal or became constant is maintained in the time until the next search procedure.

In both cases the precipitator voltage maximum value may initially be reduced to avoid frequent spark-overs, while the value during the time between the search procedures is kept close to the spark-over limit as it is controlled to assume a certain spark-over frequency.

Instead of varying the charge per conduction system half-period this quantity can be kept constant by varying the precipitator voltage. The search procedure with variation of either the number of conduction system half-periods or the number of non-conduction system half-periods is carried out as described above, however, with the change that the procedure is stopped when the precipitator voltage has assumed a maximum or has become constant, and the number of conduction system half-periods or non-conduction system half-periods, respectively, by which the voltage reached a maximum or became constant, is maintained until the next search procedure.

If the search procedure is stopped after the first change in the number of conduction or non-conduction system half-periods the search procedure is started all over again with a smaller number of conduction system half-periods or a larger number of non-conduction system half-periods, respectively. If this is impossible because the maximum number of non-conduction system half-periods or the minimum number of conduction system half-periods has been reached a variation of the original system half-period parameter is tried. If both the minimum number of conduction system half-periods and the maximum number of non-conduction system half-periods have been reached the precipitator voltage is gradually reduced as for each new precipitator voltage value a single stage of the search procedure is performed with variation of the non-conduction half-period signal. The search is stopped when a reduction in the non-conduction period entails a drop in the charge per conduction system half-period. The precipitator voltage is subsequently restricted to the existing value in the period until the next search procedure.

In all cases the control equipment may be adapted for adjusting the number of conduction system half-periods or non-conduction system half-periods, found by the search procedure, by a correction (i.e. a safety factor correction) which may either be positive or negative, and which may be preselected or influenced by one or more continuously monitored/measured precipitator or operational parameters, for example the rate of change of the ratio $n_c/n_p$ itself.

The measurement of precipitator current in the individual stages in the search procedure is made over a period of time sufficiently long to obtain a stable working point. This period of time may either be preset, being chosen on the basis of knowledge of the operational conditions of the precipitator in question, or be variable (however at least 1 second), in which case the duration of the measuring period is determined by the automatic control unit according to the variations occuring in the monitored/measured values, and stable operation is characterized in that the variations within a preselected period of time lie within a selected interval which may either be fixed or dependant on the existing current value.

In an electrostatic precipitator comprised of several sections where the individual sections are each controlled in accordance with the method according to the invention, the individual sections may be connected to a superior control unit which may be adapted so as to control totally or partly the search procedure and to coordinate the searches of the individual sections to avoid unfortunate coinciding and resulting increased dust emission.

The invention is based on the recognition that the voltage drop over the precipitated dust layer on the collecting system of an electrostatic precipitator affects the charge per conduction system half-period, and that the voltage drop increases with increasing average current in the precipitator until the occurrence of discharges in the dust layer, so-called back corona, which will restrict the voltage drop to a certain maximum value, ions simultaneously being liberated having opposite polarity in relation to that of the ions generated by the emission system. Until the start of the back corona the charge per conduction system half-period will consequently drop in case of maintained maximum voltage on the precipitator, whereas it will be constant or increasing after the occurrence of the back corona because of the restricted voltage drop over the dust layer, and because of the increased conductivity of the gas between the electrode systems.

Examples of a methods according to the invention will now be described with reference to the accompanying drawings in which.

Figure 1:
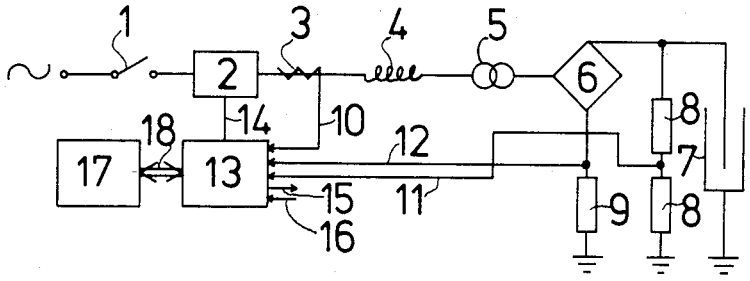
FIG. 1 shows diagrammatically a precipitator section with appertaining power supply and control equipment.

In FIG. 1 the alternating voltage of the supply mains is passed via a switch 1 to a regulator 2 which in the embodiment shown comprises one or more thyristors, and further through a current transformer 3 and an inductance 4 to a high-voltage transformer 5. The high-voltage side of the transformer 5 is connected via a rectifier coupling 6 to a precipitator section 7 and a voltage divider 8, and additionally there is inserted a current shunt 9 in series with the precipitator section. The signals on the lines 10, 11 and 12 from the current transformer 3, the voltage divider 8 and the current shunt 9 are passed to a control unit 13 controlling the regulator 2 by means of a control signal 14. The control unit 13 may, as indicated in FIG. 1, be arranged to receive and output on the lines 15 and 16 other signals involved in the control of the individual section or the entire precipitator. It may also be connected to a superior control unit 17 common to several direct voltage supplies via a connection 18, which may pass information both ways. The control units may be digital, analogue or combinations thereof. The control unit 13 may handle all control functions of the individual direct voltage supply, or one or more of these functions may be handled by the central control unit.

At predetermined intervals a search procedure is carried out to control the ratio between the time when power is supplied to the precipitator (in terms of $n_c$) and the time when no power is supplied (in terms of $n_p$) to obtain a maximum duty cycle without back-corona.

The determination of the intervals is made by the control unit 13 in accordance with its programming on the basis of information stored in this unit or received on its input line 15, e.g. concerning running parameters of the precipitator.

The time of power supply is monitored/measured as the number $n_c$ of system half-periods of conduction, and the time of no power supply as the number $n_p$ of system non-conduction half-periods.

During the search period the duty cycle $$n_c/(n_c+n_p)$$

for the power supply is first lowered and then increased stepwise, which may be done either through keeping the number $n_c$ constant and first raising the number $n_p$ and thereafter reducing it stepwise, or through keeping the number $n_p$ constant and first reducing the number $n_c$ and thereafter raising it stepwise or by varying both.

The stepwise change of $n_p$, $n_c$ or $n_c$ and $n_p$ and consequently of:

$$n_c/(n_c+n_p)$$

is performed by the control unit 13 in accordance with its programming on the basis of information received by this unit on its input line or stored in the unit.

Figure 2:
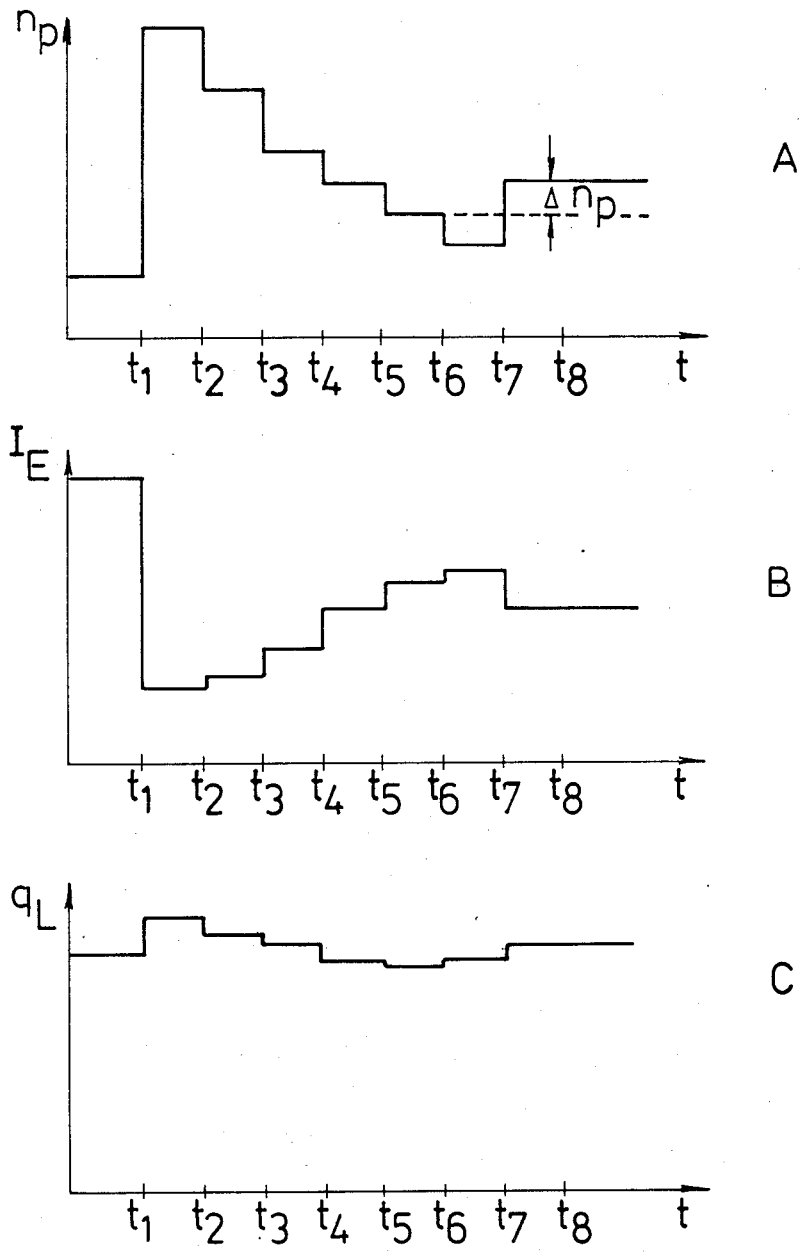
FIG. 2 shows an example of current and charge sequences when varying the number of non-conduction system half-periods.

FIG. 2 illustrates a search procedure for controlling a power supply to the limit of back-corona.

The maximum voltage of the precipitator is kept constant. At the time $t_1$, the number of system non-conduction half-periods $n_p$ is increased as shown by the curve A. The precipitator current $I_E$ decreases as shown by the curve B, but the charge per system half-period of conduction, $q_L$, increases as shown by the curve C. By stepwise reduction of $n_p$, $q_L$ drops to its minimum at the time $t=t_5$. This minimum is found by continuing the stepwise decrease of $n_p$ until $q_L$, when passing from the step beginning at $t_5$ to the step beginning at $t_6$, increases, which indicates that the minimum was at the step beginning at $t_5$. Consequently, the number of system non-conduction half-periods, $n_p$, to be maintained is the number determined on the basis of the step beginning at $t_5$ in the curve A to which a correction $\Delta n_p$ is added to the number indicated by this step.

Figure 4:
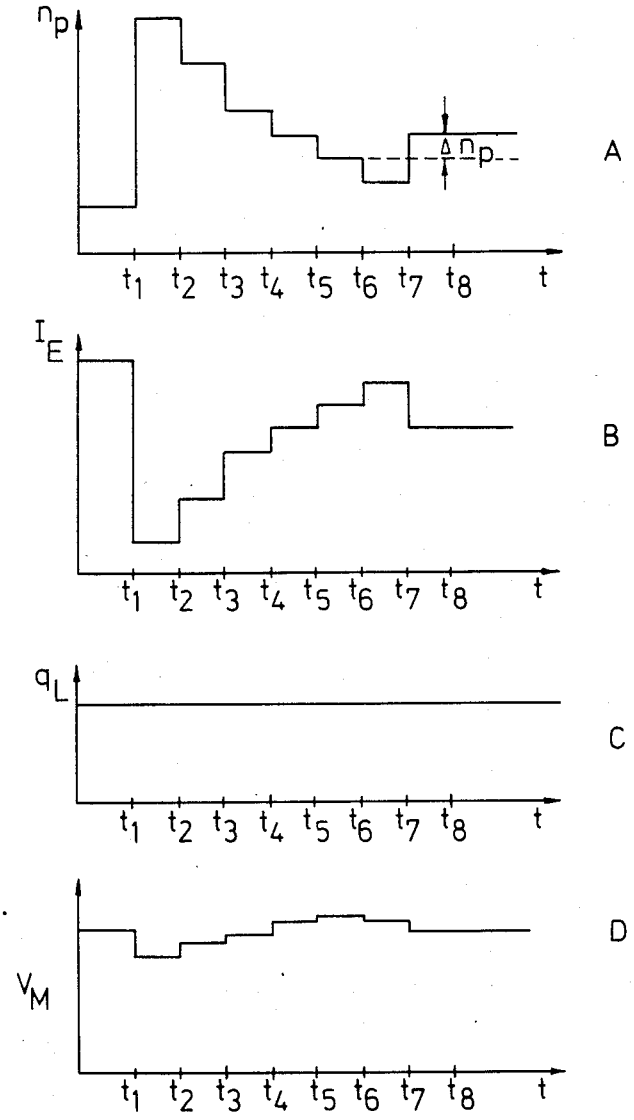

Another way of performing the search procedure by varying the number of system non-conduction half-periods is shown in FIG. 4.

According to this figure the number of system non-conduction half-periods, $n_p$, is also increased at the time $t_1$ as shown by curve A. The precipitator current $I_E$ decreases as shown by curve B, but the maximum precipitator voltage $V_M$ is, as shown by curve D, controlled so that the charge per system half-period of conduction is kept at its value before the beginning of the search procedure as illustrated by curve C. When $n_p$ is decreased stepwise the maximum voltage of the filter is still controlled to keep the charge per system half-period of conduction constant. This is obtained by stepwise increasing the maximum voltage. When passing from the step beginning at $t_5$ to the step beginning at $t_6$, however, the controlling of the maximum voltage calls for a decrease in the voltage. Consequently, the number of system non-conduction half-periods determined by the step beginning at $t_5$ is the number to be maintained until the next search procedure is performed.

Figure 3:
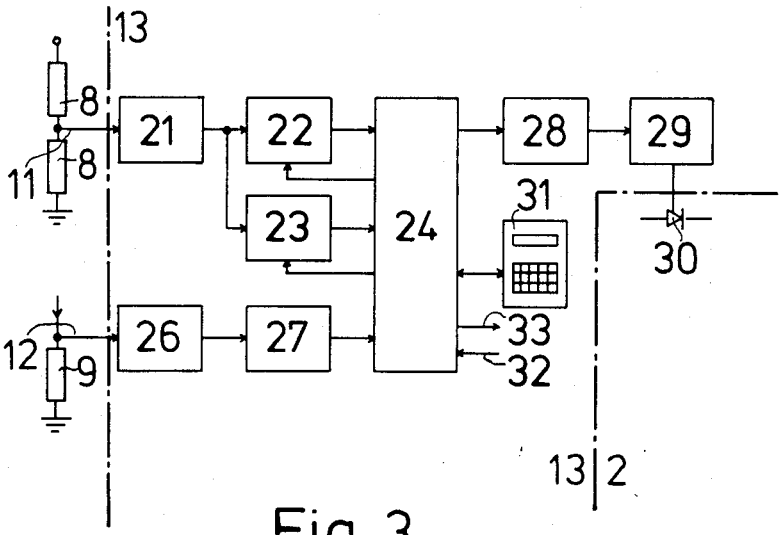
FIG. 3 shows a practical embodiment of such part of the control equipment which effects the control of maximum voltage and the number of conduction and non-conduction system half-periods; and, FIG. 4 shows a further example of current and charge sequences, when varying the number of system non-conduction half periods.

FIG. 3 shows an example of a practical embodiment of the invention using a microprocessor to control the search procedure. The signal on the line 20 from the voltage divider 8,8 is passed to part of the control unit 13, via an interface 21, specifically to a spark-over detector and a peak-detector 22 measuring and maintaining the maximum value of the precipitator voltage for one system half-period. The signals are passed from here to the microprocessor. Similarly, the signal from the current shunt 9 is passed to the microprocessor in the control unit 9 via an interface 26 and an analogue/-digital converter. In the microprocessor monitored/-measured data are treated, utilizing a program stored in a memory, and based thereon the launching of trigger pulses, to the thyristors 30 in the regulator 2 of the power supply, is controlled via interface 28 and a pulse generating circuit 29. The communication with the microprocessor takes place via a keyboard with display 31. In addition the microprocessor may be arranged to output and receive other signals or to be coupled to a superior control unit. This is indicated by the connections 32 and 33 for simplicity.

I claim:

1. A method of controlling the period length of an intermittent voltage supply from a power supply to an electrostatic precipitator, in which (a) a search procedure is carried out at predetermined time intervals, and during which procedure:

(b) a series of increasing values is given to the ratio of $n_c/n_p$ between the number of conduction half periods $n_c$ during which said power supply supplies current to said precipitator and the number of non-conduction half periods $n_p$ during which said power supply to said precipitator is cut off, said increasing values being obtained through stepwise altering of at least one of the numbers $n_c$ or $n_p$ according to a selected scale;

(c) the charge transmitted per system half-period is calculated at each scale step, said charge being defined as the average current of said precipitator divided by the total number $n_c$ of said conduction system half-periods per second;

(d) said search procedure being stopped when the ratio between the maximum voltage and the charge transmitted per system half-period remains constant or decreases at transition from one scale step to the succeeding one; and, (e) the number of conduction system half-periods $n_c$ and of non-conduction system half-periods $n_p$ so obtained determining the numbers of conduction system half-periods and non-conduction system half-periods to be maintained in said precipitator until the next search procedure.

2. A method according to claim 1, in which the predetermination of the time intervals between the search procedures is automatically performed on the basis of at least one continuously monitored precipitator parameter.

3. A method according to claim 1, in which the predetermination of the time intervals between the search procedures is automatically performed on the basis of at least one continuously monitored operational parameter.

4. A method according to claim 1, in which said selection of said scale for changing said number of non-conduction $n_p$ or conduction $n_c$ half-periods is automatically performed in advance of each said search procedure on the basis of at least one continuously monitored precipitator parameter.

5. A method according to claim 1, in which said selection of said scale for changing said number of non-conduction $n_p$ or conduction $n_c$ half-periods is automatically performed in advance of each said procedure on the basis of at least one continuously monitored operational parameter.

6. A method according to claim 1, in which the maximum voltage and the number of non-conduction $n_p$ system half-periods are kept constant during the search procedure, during which the number of conduction $n_p$ system half-periods is first, if possible, reduced and then increased stepwise until the charge per conduction system half-period has assumed a minimum or has become constant, whereafter the number of conduction $n_c$ system half-periods by which the charge per conduction system half-period was minimal or became constant is maintained in the time until the next search procedure.

7. A method according to claim 1, in which the maximum voltage and the number of conduction $n_c$ system half-periods are kept constant during the search procedure, during which the number of non-conduction $n_p$ system half-periods, if possible, is first increased and then reduced stepwise until the charge per conduction system half-period has assumed a minimum or has become constant, whereafter the number of non-conduction $n_p$ system half-periods by which the charge per conduction system half-period was minimal or became constant is maintained in the time until the next search procedure.

8. A method according to claim 1, in which the number of non-conduction $n_p$ system half-periods and the charge per conduction system half-period are kept constant during the search period, the latter by regulating the precipitator voltage, while the number of conduction $n_c$ system half-periods is first reduced and then increased stepwise until the precipitator voltage has assumed a maximum or has become constant, whereafter the number of conduction $n_c$ half-periods in the time until the next search procedure is kept at the value at which the precipitator voltage reached a maximum or became constant.

9. A method according to claim 1, in which the number of conduction $n_c$ system half-periods and the charge per conduction system half-period are kept constant during the search period, the latter by regulating the precipitator voltage, while the number of non-conduction $n_p$ system half-periods is first increased and then reduced stepwise until the precipitator voltage has assumed a maximum or has become constant, whereafter the number of non-conduction $n_p$ half-periods in the time until the next search procedure is kept at the value at which the precipitator voltage reached a maximum or became constant.

10. A method according to claim 1, in which if said search procedure is stopped after the first change in the number of conduction $n_c$ or non-conduction $n_p$ system half-periods the search procedure is started all over again with a smaller number of conduction $n_c$ system half-periods or a larger number of non-conduction $n_p$ system half-periods, respectively, and if said maximum number of non-conduction $n_p$ system half-periods or the minimum number of conduction $n_c$ system half-periods has been reached, the procedure is repeated, the maximum precipitator voltage gradually being decreased until a drop in the charge per conduction system half-period or an increase in precipitator voltage, whereafter said precipitator voltage is kept at that value until the next search procedure is started.

11. A method according to claim 1, in which a correction is made to the number of non-conduction $n_p$ system half-periods.

12. A method according to claim 1, in which a correction is made to the number of conduction $n_c$ system half-periods.

13. A method according to claim 11 or claim 12, wherein said correction is positive.

14. A method according to claim 11 or 12, wherein said correction is negative.

15. A method according to claim 11 or claim 12, in which the correction is preselected.

16. A method according to claim 11 or claim 12, in which the correction is influenced by at least one continuously measured parameter.

17. A method according to claim 1, in which said increasing values of the ratio $n_c/n_p$ are obtained by stepwise altering of both the numbers $n_c$ and $n_p$.

* * * * *